US011400718B2

(12) United States Patent
Yanase

(10) Patent No.: US 11,400,718 B2
(45) Date of Patent: Aug. 2, 2022

(54) LIQUID DISCHARGE APPARATUS

(71) Applicant: Ricoh Company, Ltd., Tokyo (JP)

(72) Inventor: Norikazu Yanase, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/189,002

(22) Filed: Mar. 1, 2021

(65) Prior Publication Data

US 2021/0283914 A1 Sep. 16, 2021

(30) Foreign Application Priority Data

Mar. 12, 2020 (JP) ..... JP2020-042674
Dec. 4, 2020 (JP) ..... JP2020-202328

(51) Int. Cl.
*B41J 2/165* (2006.01)

(52) U.S. Cl.
CPC ..... *B41J 2/16505* (2013.01)

(58) Field of Classification Search
CPC ..... B41J 2/16505
See application file for complete search history.

(56) References Cited

U.S. PATENT DOCUMENTS

2012/0298036 A1* 11/2012 Ogawa ..... B41J 3/28 118/712
2013/0113861 A1 5/2013 Kikura et al.
2013/0113862 A1 5/2013 Kemma et al.
2013/0257986 A1 10/2013 Yanase et al.
2014/0028752 A1 1/2014 Kikura et al.
2014/0029023 A1 1/2014 Yanase et al.
2014/0078232 A1 3/2014 Kondo et al.
2014/0079461 A1 3/2014 Obata et al.
2014/0097288 A1 4/2014 Yanase et al.
2014/0099148 A1 4/2014 Obata et al.
2014/0099149 A1 4/2014 Kikura et al.
2014/0099150 A1 4/2014 Matsumoto et al.
2014/0105661 A1 4/2014 Kondo et al.
2014/0253623 A1 9/2014 Nakano et al.
2015/0054898 A1 2/2015 Kondo et al.
2015/0077459 A1 3/2015 Yanase et al.
2015/0077494 A1 3/2015 Obata et al.
2015/0091971 A1 4/2015 Matsumoto et al.
2016/0031239 A1 2/2016 Yanase et al.
2018/0313033 A1 11/2018 Yanase et al.
2019/0009586 A1 1/2019 Yanase et al.
(Continued)

FOREIGN PATENT DOCUMENTS

JP 2003-103772 4/2003
JP 2005-001326 1/2005
JP 2012-166159 9/2012
(Continued)

*Primary Examiner* — Justin Seo
(74) *Attorney, Agent, or Firm* — Xsensus LLP

(57) ABSTRACT

A liquid discharge apparatus includes a head configured to discharge a liquid onto a print target, a carriage configured to hold the head and reciprocally movable in a main-scanning direction, a sealing configured to seal a nozzle surface of the head, and a support configured to hold the print target and movable in a sub-scanning direction perpendicular to the main-scanning direction, the support including a space configured to accommodate the sealing in the support.

18 Claims, 16 Drawing Sheets

(56) References Cited

U.S. PATENT DOCUMENTS

2019/0240981 A1 8/2019 Tachibana et al.

FOREIGN PATENT DOCUMENTS

| | | | | |
|---|---|---|---|---|
| JP | 2012-245671 | | 12/2012 | |
| JP | 2019-137040 | | 8/2019 | |
| WO | WO2010/071041 | A1 | 6/2010 | |
| WO | WO-2010071041 | A1 * | 6/2010 | ..... B41J 2/165 |

* cited by examiner

LIQUID DISCHARGE APPARATUS

CROSS-REFERENCE TO RELATED APPLICATIONS

This patent application is based on and claims priority pursuant to 35 U.S.C. § 119(a) to Japanese Patent Application No. 2020-042674, filed on Mar. 12, 2020, in the Japan Patent Office and Japanese Patent Application No. 2020-202328, filed on Dec. 4, 2020, in the Japan Patent Office, the entire disclosures of which are hereby incorporated by reference herein.

BACKGROUND

Technical Field

Aspect of this disclosure relates to a liquid discharge apparatus.

Related Art

A liquid discharge apparatus includes a head to discharge a liquid from nozzles formed on a nozzle surface of the head and a maintenance unit to maintain and recover a discharge function of the head. The maintenance unit includes a sealing to seal the nozzle surface of the head and a wiper to wipe the nozzle surface of the head, for example.

A printer as the liquid discharge apparatus to print on a fabric includes the maintenance unit to maintain the head. The maintenance unit is disposed on one end of the printer in a moving direction of a carriage mounting the head and also on a side of a stage to hold the fabric. The maintenance unit includes the sealing to seal the nozzle surface of the head.

SUMMARY

In an aspect of this disclosure, a liquid discharge apparatus includes a head configured to discharge a liquid onto a print target, a carriage configured to hold the head and reciprocally movable in a main-scanning direction, a sealing configured to seal a nozzle surface of the head, and a support configured to hold the print target and movable in a sub-scanning direction perpendicular to the main-scanning direction, the support including a space configured to accommodate the sealing in the support.

In another aspect of this disclosure, a liquid discharge apparatus includes a head configured to discharge a liquid onto a print target, a sealing configured to seal a nozzle surface of the head, and a conveyor configured to convey the print target in a sub-scanning direction. The conveyor includes a stage on which the print target is placed, a stage cover configured to movably support the stage in the sub-scanning direction, and the stage and the sealing are parallelly disposed on the stage cover in the sub-scanning direction.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1:
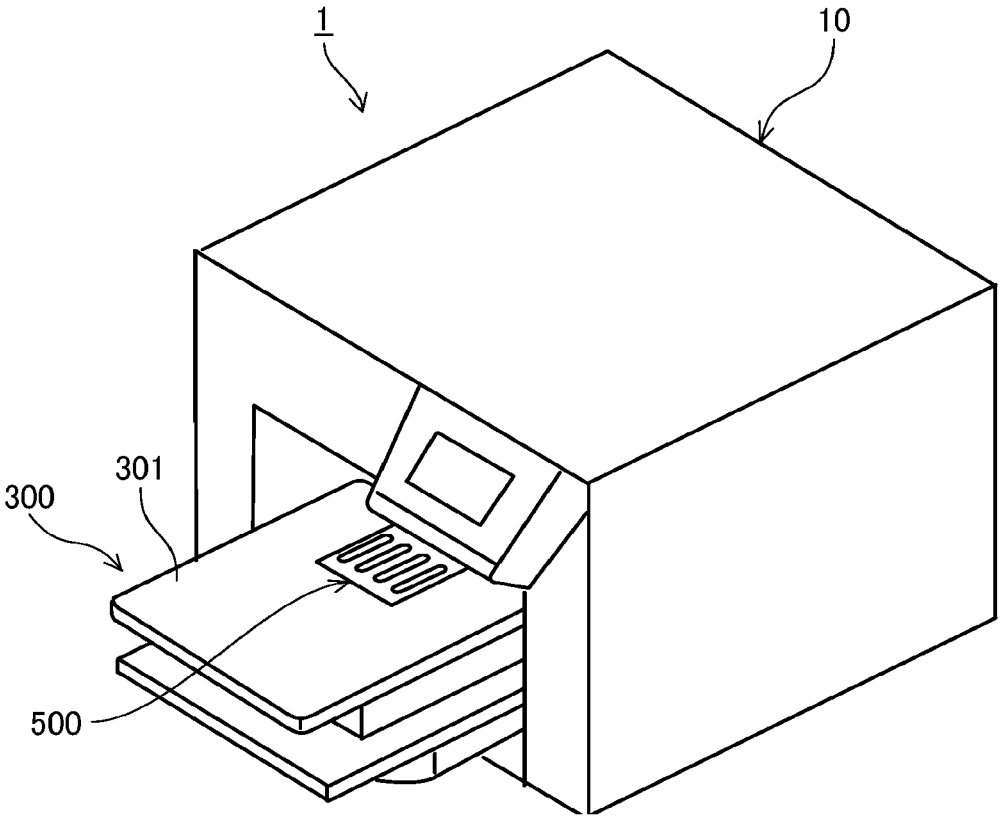
FIG. 1 is a schematic external perspective view of a printer as a liquid discharge apparatus according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms “a,” “an,” and "the" are intended to include the plural forms as well, unless the context clearly indicates otherwise.

Referring now to the drawings, wherein like reference numerals designate identical or corresponding parts throughout the several views, embodiments of the present disclosure are described below. A first embodiment of the present disclosure is described below with reference to FIGS. 1 to 3.

FIG. 1 is a schematic external perspective view of a printer 1 as a liquid discharge apparatus according to the first embodiment of the present disclosure.

Figure 2A:
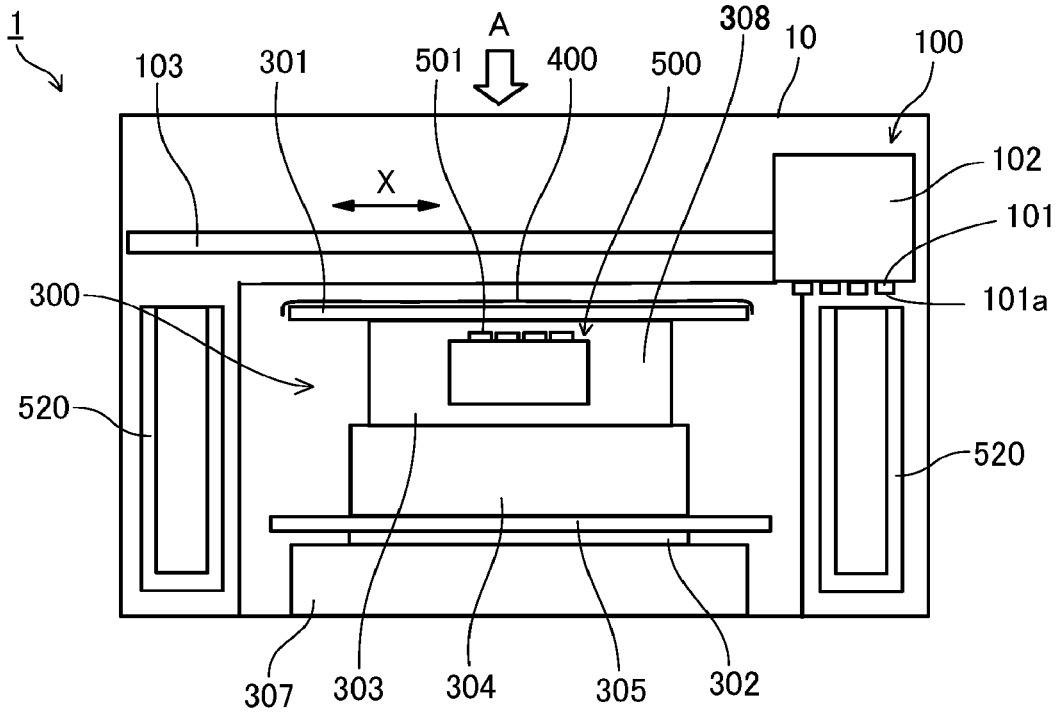
FIGS. 2A and 2B are schematic cross-sectional front views of the printer according to the first embodiment of the present disclosure.
Figure 2B:
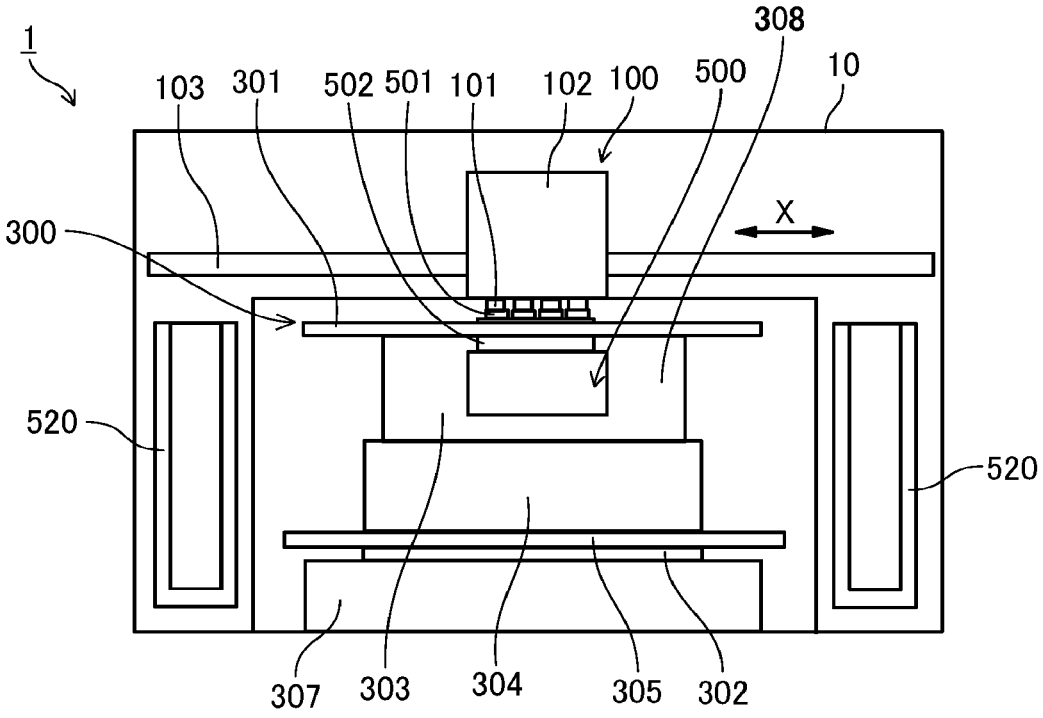

FIGS. 2A and 2B are schematic cross-sectional front views of the printer 1 according to the first embodiment of the present disclosure.

Figure 3A:
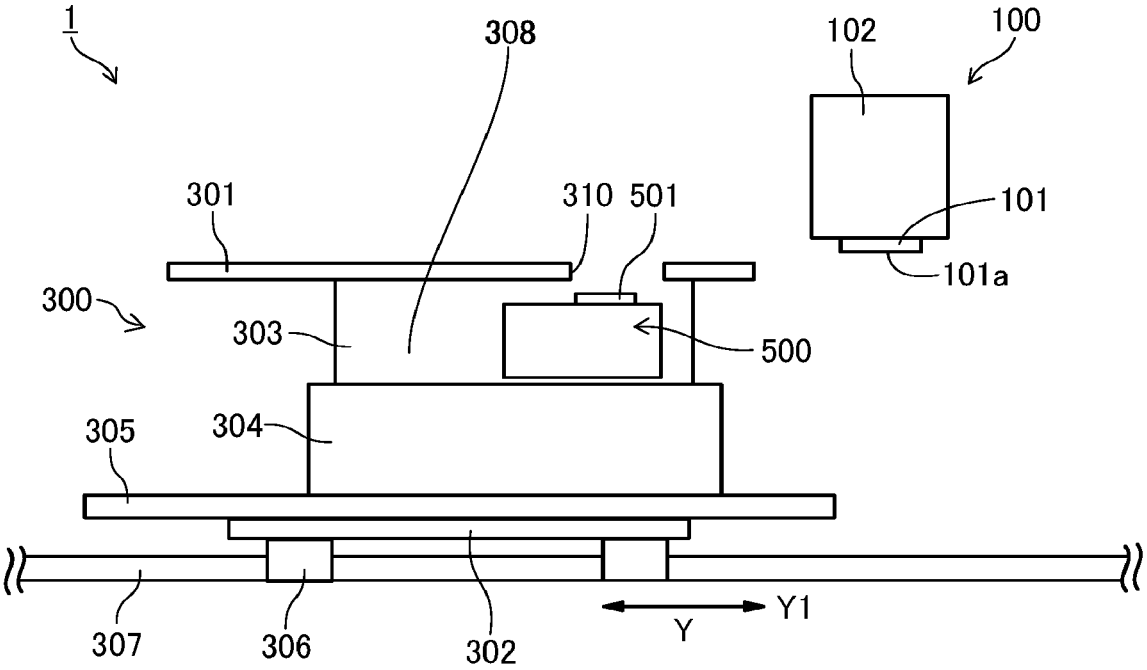
FIGS. 3A and 3B are schematic cross-sectional side views of the printer according to the first embodiment of the present disclosure.
Figure 3B:
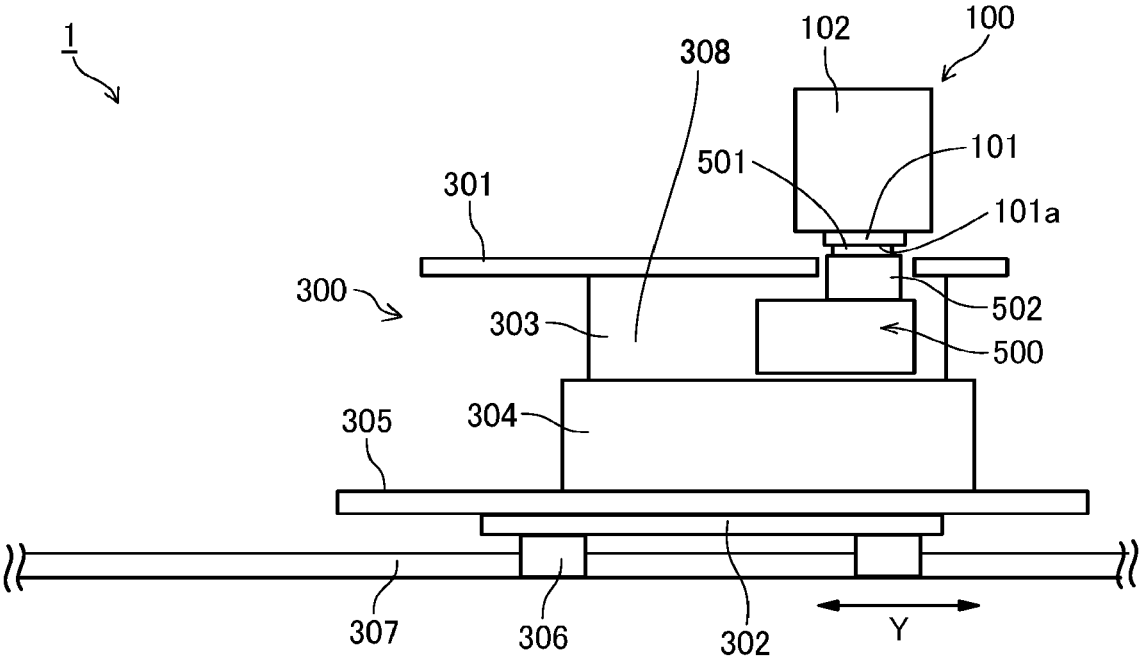

FIGS. 3A and 3B are schematic cross-sectional side views of the printer 1 according to the first embodiment of the present disclosure.

The printer 1 includes a support 300 and a printing device 100 in an apparatus body 10. The support 300 supports a fabric 400 (see FIG. 2A) as an application target (print target). The printing device 100 prints an image on the fabric 400 movably supported by the support 300.

The printing device 100 includes one or a plurality of heads 101 (see FIG. 2A) to discharge a liquid and a carriage 102 mounting the one or the plurality of liquid discharge heads 101. Hereinafter, the one or the plurality of liquid discharge heads is simply referred to as a "head." The printer 1 includes a guide 103 as a guide to guide the carriage 102 so that the carriage 102 is reciprocally movable in a main-scanning direction as indicated by arrow "X."

The support 300 includes a stage 301 on which the fabric 400 is placed, and a slider 302 that supports the stage 301 (see FIGS. 2A to FIG. 3B). The support 300 includes a space 308 between the slider 302 and the stage 301, and the space 308 is covered with an upper stage cover 303, a lower stage cover 304, and a slider cover 305 (see FIGS. 2A to FIG. 3B).

The printer 1 includes a guide 307 and a bearing 306 so that the slider 302 of the support 300 is movably supported by the guide 307 via the bearing 306 in the sub-scanning direction (Y direction) as indicated by arrow "Y."

The sub-scanning direction (Y direction) is a conveyance direction of the fabric 400 (print target) supported by the support 300. The support 300 is also a conveyor to convey the fabric 400 as the print target.

Further, the maintenance unit 500 includes a sealing 501 under the stage 301 in the support 300. The sealing 501 serves as a cap of the maintenance unit 500 configured to cap the nozzle surface 101*a* of the head 101. The sealing 501 serving as a cap includes a tip made of rubber to contact with the nozzle surface 101*a* of the head 101. The tip of the sealing 501 has a rectangular or an elliptical plan view in which rectangular or elliptical rubber surrounding a space (opening) to suck an ink from the nozzles formed in the nozzle surface 101*a* of the head 101.

The sealing 501 of the maintenance unit 500 may be arranged in a region of the support 300 in a plan view of a surface of the support 300 to support the fabric 400 (print target) from a direction indicated by arrow "A" in FIG. 2A. For example, the sealing 501 is disposed inside a region of the support 300 in the main-scanning direction X. Further, the sealing 501 is disposed inside a region of a conveyance of the fabric 400 (print target) of the support 300 in the sub-scanning direction Y.

The support 300 serves as a conveyor to convey the fabric 400 (print target) in the sub-scanning direction Y, and the sealing 501 is disposed inside the support 300.

Thus, the support 300 is configured to hold the fabric 400 (print target) and is movable in a sub-scanning direction Y perpendicular to the main-scanning direction X. The support 300 includes a space 308 configured to accommodate the sealing 501 in the support 300.

The maintenance unit 500 includes a plurality of sealings 501 to respectively seal (cap) the nozzle surfaces 101*a* of the heads 101. The maintenance unit 500 includes a sealing holder 502 to hold the plurality of sealings 501. The sealing holder 502 is vertically movable so that the plurality of sealings 501 vertically moves to retract from and advance toward the nozzle surface 101*a* of the head 101. In addition to the sealing 501, the maintenance unit 500 may also include a wiper to wipe the nozzle surface 101*a* of the head 101.

The stage 301 includes an opening 310 that opens an upper part of the sealing 501 of the maintenance unit 500 as illustrated in FIG. 3A. The opening 310 has a size (area) large enough to pass the sealing holder 502 of the maintenance unit 500 through the opening 310 in the printer 1 according to the first embodiment.

The printer 1 includes dummy-discharge receptacles 520 on both ends of the printer 1 in the main-scanning direction X. The dummy-discharge receptacles 520 receives a liquid discharged from the head 101 and not applied on the fabric 400 (print target).

The printer 1 according to the first embodiment moves the support 300 at a position illustrated in FIGS. 2A and 3A in a sub-scanning direction Y1 (rightward direction in Y direction) indicated by arrow "Y1" to seal (cap) the nozzle surface 101*a* of the head 101 with the sealing 501, for example.

As illustrated in FIGS. 2B and 3B, the sealing 501 of the maintenance unit 500 is disposed below the head 101. Then, the printer 1 elevates the sealing holder 502 of the maintenance unit 500 to pass through the opening 310 of the stage 301 and seals (caps) the nozzle surface 101*a* of the head 101 with the sealing 501.

Thus, the sealing 501 of the maintenance unit 500 is arranged inside the support 300. That is, the sealing 501 of the maintenance unit 500 is arranged in an area of the stage 301 of the support 300 in a plan view. Thus, the printer 1 can reduce (shorten) a width of the printer 1 in the main-scanning direction X (X direction).

Specifically, the printer 1 has a layout in which the width of the printer 1 in the main-scanning direction X is sum of a width of a print area, a width of an acceleration and deceleration distance of the carriage 102, and a width of the dummy-discharge receptacle 520 without a width of the maintenance unit 500 since the maintenance unit 500 is disposed inside the print area.

Thus, the printer 1 can reduce a size in a width of the apparatus body 10 compared with a case in which the sealing 501 of the maintenance unit 500 and the dummy-discharge receptacle 520 are arranged outside the print area.

The printer 1 according to a second embodiment of the present disclosure is described with reference to FIG. 4.

Figure 4A:
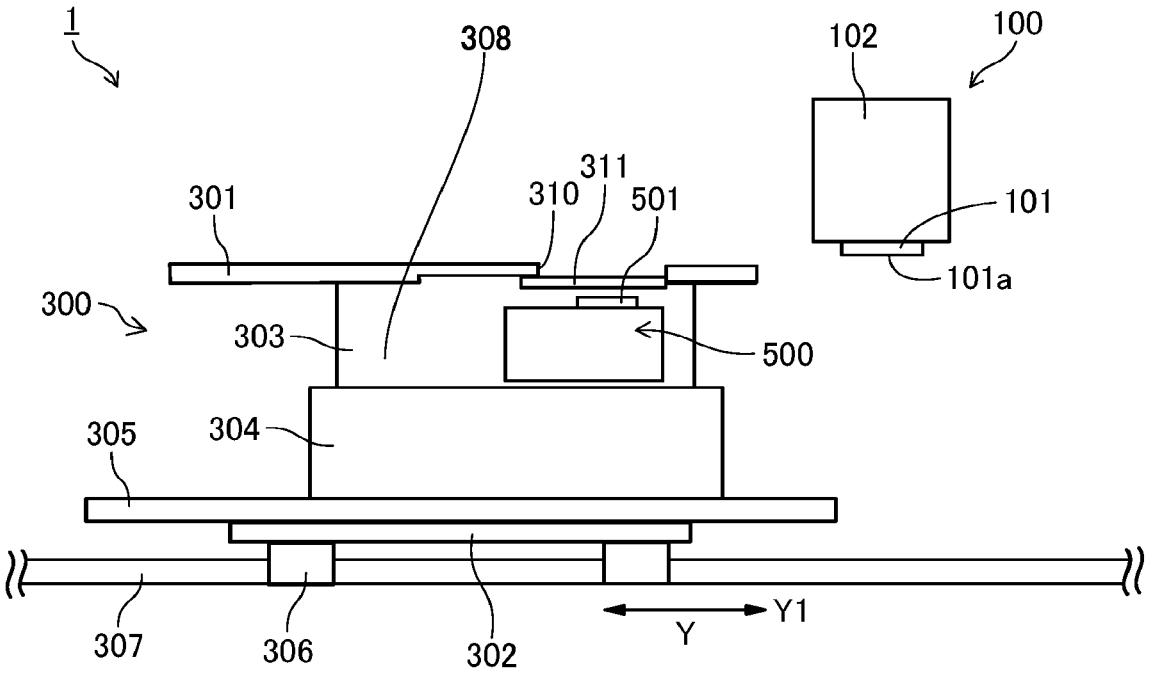
FIGS. 4A and 4B are schematic side views of the printer similar to FIGS. 3A and 3B to illustrate the printer according to a second embodiment of the present disclosure.
Figure 4B:
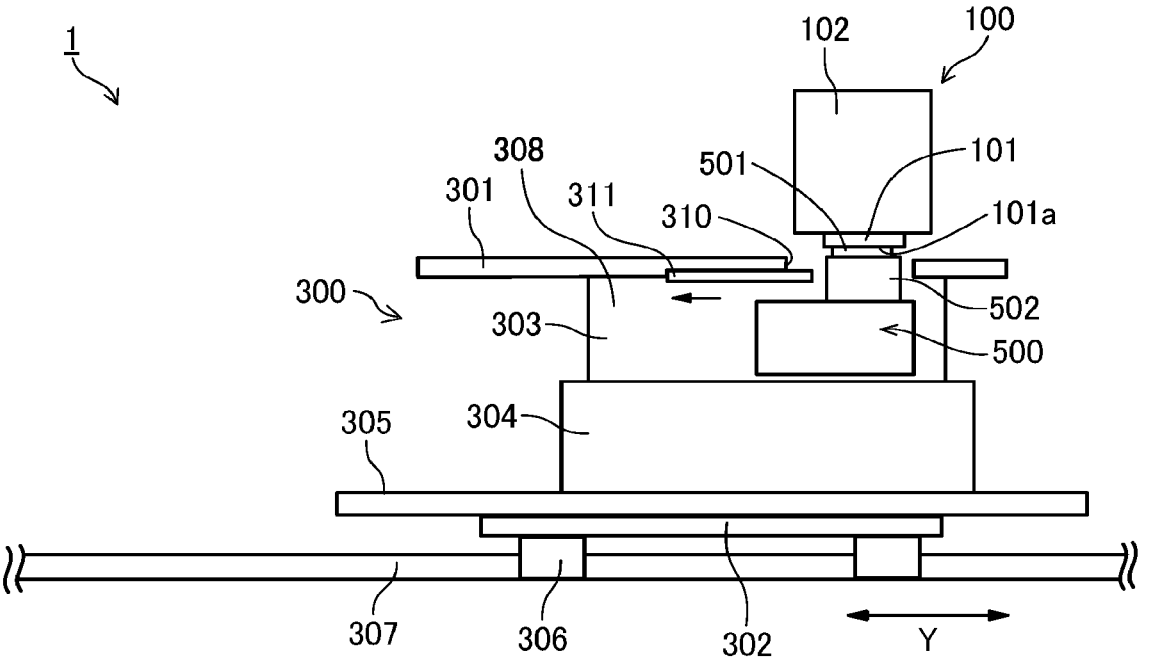

FIGS. 4A and 4B are schematic side views of the printer 1 similar to FIGS. 3A and 3B to illustrate the printer 1 according to the second embodiment.

The printer 1 according to the second embodiment includes a shutter 311 to open and close the opening 310 of the stage 301 according to the first embodiment. The opening 310 opens the upper part of the sealing 501 of the maintenance unit 500. The shutter 311 is movable between a closing position to close the opening 310 and an opening position to open the opening 310.

The printer 1 according to the second embodiment moves the support 300 at a position illustrated in FIG. 4A in the sub-scanning direction Y1 (rightward direction in Y direction) to seal (cap) the nozzle surface 101*a* of the head 101 with the sealing 501, for example.

As illustrated in FIG. 4B, the sealing 501 of the maintenance unit 500 is disposed below the head 101. Then, the printer 1 moves the shutter 311 in a direction (leftward direction in FIG. 4B) indicated by arrow to open the opening 310. Then, the printer 1 elevates the sealing holder 502 of the maintenance unit 500 to pass through the opening 310 of the stage 301 and seals (caps) the nozzle surface 101*a* of the head 101 with the sealing 501.

As described above, the support 300 includes the shutter 311 to open and close the opening 310 that opens the upper part of the sealing 501 of the maintenance unit 500. When the sealing 501 of the maintenance unit 500 is used, the shutter 311 moves in the sub-scanning direction Y (leftward direction in FIG. 4B) to open the opening 310.

Thus, the shutter 311 of the printer 1 can prevent the fabric 400 (print target) supportably placed on the stage 301 of the support 300 from coming into contact with the sealing 501 of the maintenance unit 500 and soil the fabric 400 (print target).

Next, the printer 1 according to a third embodiment of the present disclosure is described with reference to FIG. 5.

Figure 5A:
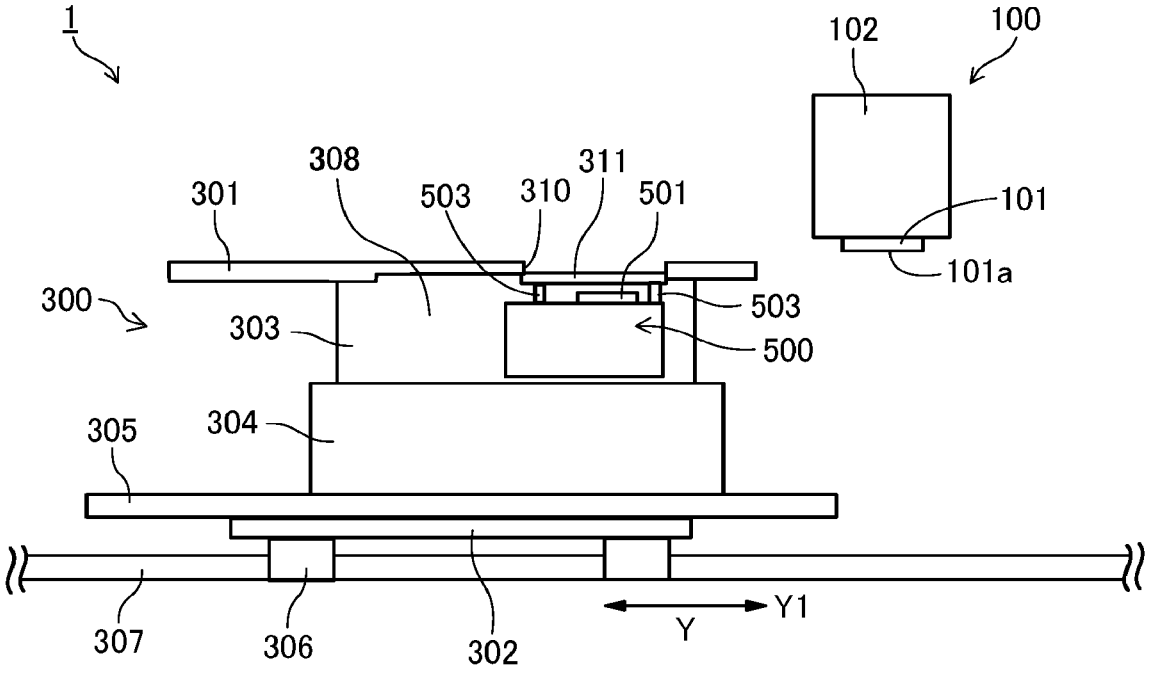
FIGS. 5A and 5B are schematic side views of the printer similar to FIGS. 3A and 3B to illustrate the printer according to a third embodiment of the present disclosure.
Figure 5B:
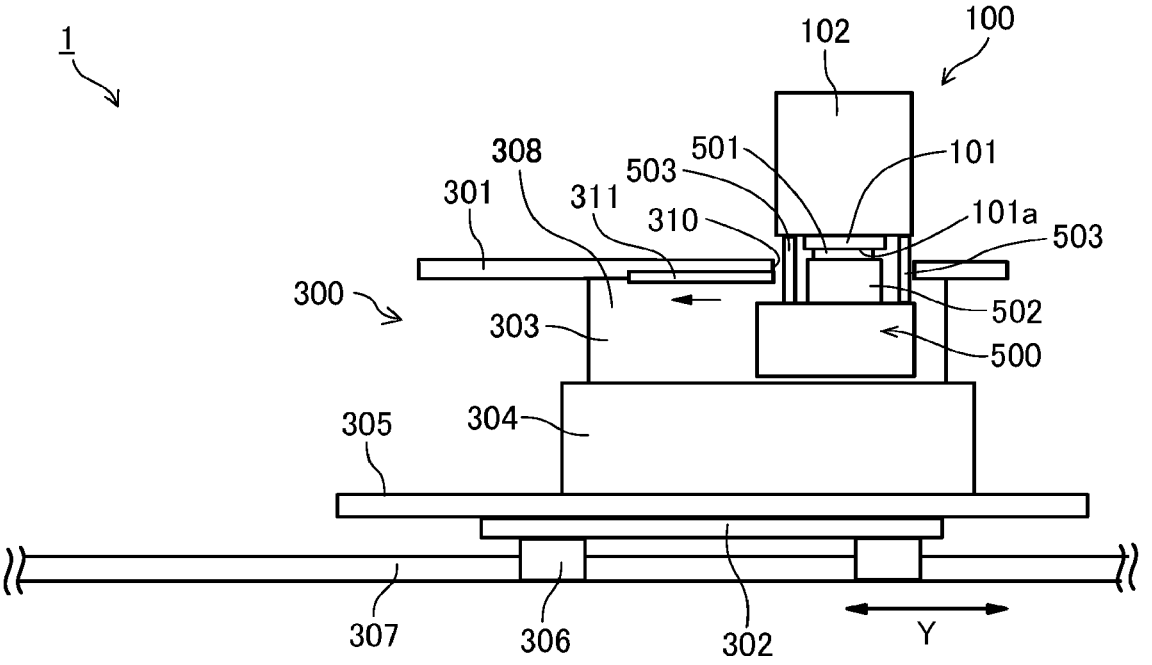

FIGS. 5A and 5B are schematic side views of the printer 1 similar to FIGS. 3A and 3B to illustrate the printer 1 according to the third embodiment.

The printer 1 according to the third embodiment includes a protector 503 to surround the nozzle surface 101*a* of the head 101 and the sealing 501 according to the second embodiment. The protector 503 serves as a dirt prevention member to prevent the stage 301 of the support 300 from becoming dirty by the liquid on the nozzle surface 101*a* of the head 101 and the liquid on the sealing 501. The sealing holder 502 holds the protector 503 and vertically moves the protector 503.

The printer 1 according to the third embodiment moves the support 300 at a position illustrated in FIG. 5A in the sub-scanning direction Y1 (rightward direction in Y direction) to seal (cap) the nozzle surface 101*a* of the head 101 with the sealing 501, for example.

Then, as illustrated in FIG. 5B, the sealing 501 of the maintenance unit 500 is disposed below the head 101. Then, the printer 1 moves the shutter 311 in a direction (leftward direction in FIG. 5B) indicated by arrow to open the opening 310. Then, the printer 1 elevates the sealing holder 502 of the maintenance unit 500 to pass through the opening 310 of the stage 301 and seals (caps) the nozzle surface 101*a* of the head 101 with the sealing 501.

At this time (when the sealing 501 seals the nozzle surface 101*a*), the protector 503 also rises and surrounds the nozzle surface 101*a* of the head 101 and the sealing 501.

Thus, the printer 1 can prevent the stage 301 of the support 300 from becoming dirty even if a residual liquid adhering to the nozzle surface 101*a* of the head 101 is scattered due to sealing of the head 101 by the sealing 501 or the like. Thus, the printer 1 can prevent the fabric 400 (print target) from becoming dirty due to the dirt (liquid) on the stage 301.

Next, the printer 1 according to a fourth embodiment of the present disclosure is described with reference to FIGS. 6A and 6B.

Figure 6A:
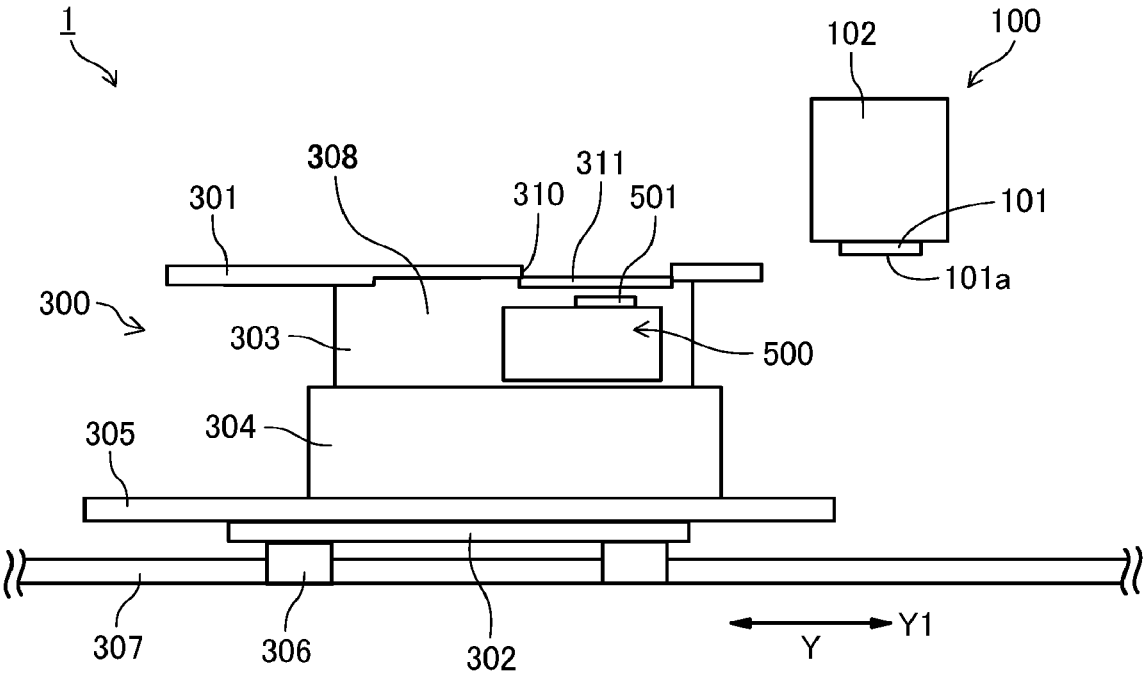
FIGS. 6A and 6B are schematic side views of the printer similar to FIGS. 3A and 3B to illustrate the printer according to a fourth embodiment of the present disclosure.
Figure 6B:
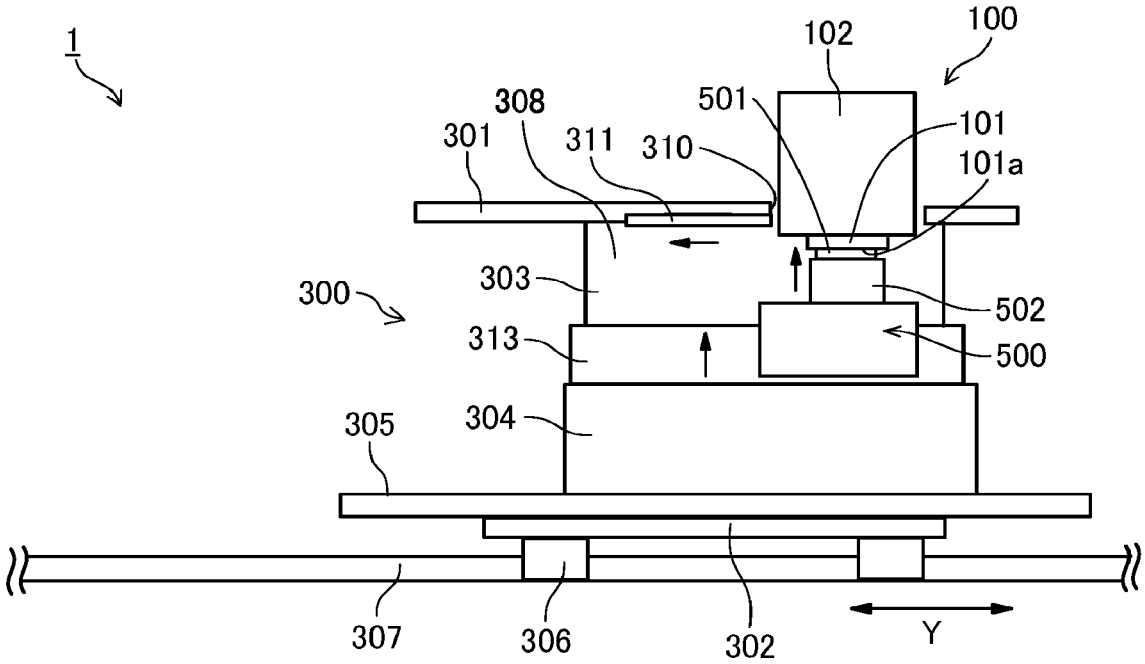

FIGS. 6A and 6B are schematic side views of the printer 1 similar to FIGS. 3A and 3B to illustrate the printer 1 according to the fourth embodiment.

The printer 1 according to the fourth embodiment includes the opening 310 of the stage 301 having a size large enough to pass the carriage 102 through the opening 310 of the stage 301.

Further, the stage 301 of the support 300 is elevatable to a sealing (capping) position at which the head 101 passes through the opening 310 of the stage 301 and the sealing 501 of the maintenance unit 500 seals the nozzle surface 101*a* of the head 101.

Further, the printer 1 includes an intermediate stage cover 313 between an upper stage cover 303 and a lower stage cover 304. The intermediate stage cover 313 is accommodated inside the lower stage cover 304 when the intermediate stage cover 313 moves downward.

The printer 1 according to the fourth embodiment moves the support 300 at a position illustrated in FIG. 6A in the sub-scanning direction Y1 (rightward direction in Y direction) to seal (cap) the nozzle surface 101*a* of the head 101 with the sealing 501, for example.

Then, as illustrated in FIG. 6B, the sealing 501 of the maintenance unit 500 is positioned below the head 101. Then, the printer 1 moves the shutter 311 in a direction (leftward direction in FIG. 5B) indicated by arrow to open the opening 310.

Then, the printer 1 elevates (raises) the stage 301 of the support 300 so that the carriage 102 is inserted into and passes through the opening 310 of the stage 301. Then, the printer 1 elevates the sealing holder 502 of the maintenance unit 500 to seal (cap) the nozzle surface 101*a* of the head 101 with the sealing 501.

At this time (when the sealing 501 seals the nozzle surface 101*a*), the nozzle surface 101*a* of the head 101 is moved downward to a position below the opening 310 of the stage 301 as illustrated in FIG. 6B.

Thus, the printer 1 can prevent the stage 301 of the support 300 from becoming dirty even if a residual liquid adhering to the nozzle surface 101*a* of the head 101 is scattered due to sealing of the head 101 by the sealing 501 or the like. Thus, the printer 1 can prevent the fabric 400 (print target) from becoming dirty due to the dirt (liquid) on the stage 301.

Next, the printer 1 according to a fifth embodiment of the present disclosure is described with reference to FIG. 7.

Figure 7:
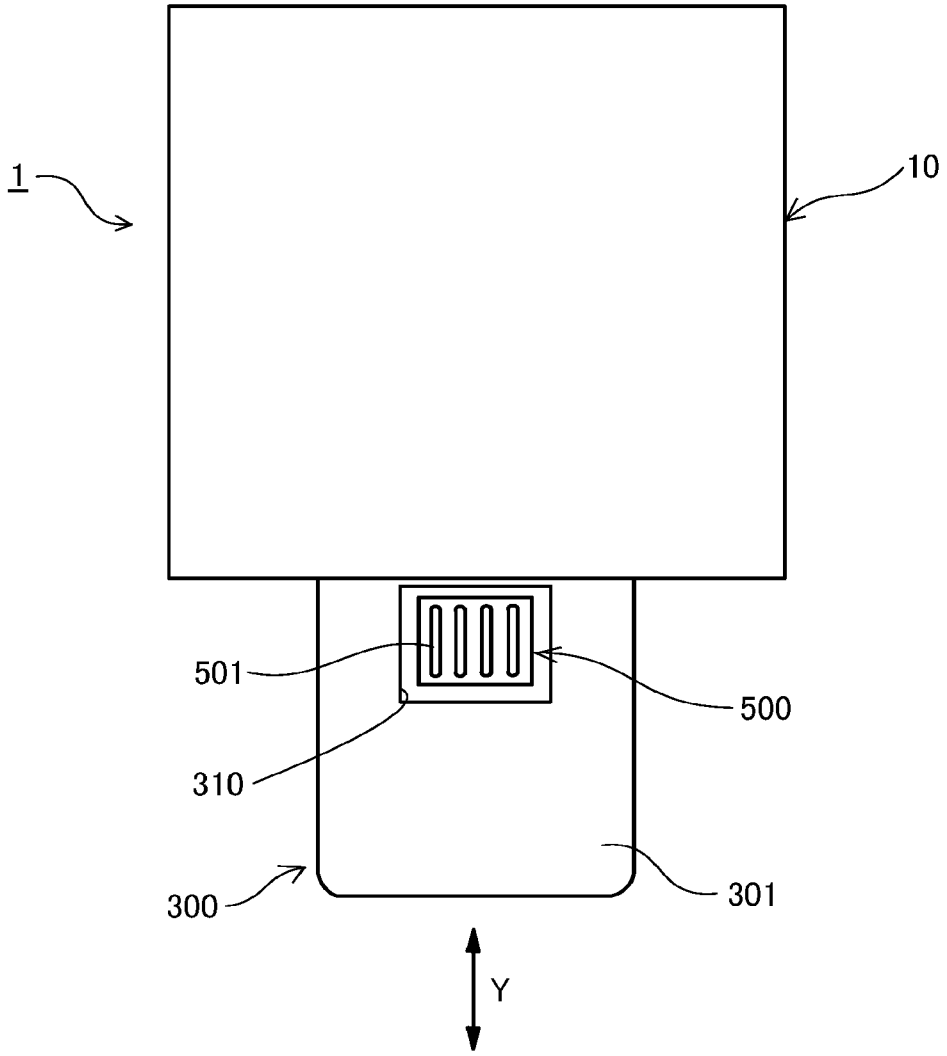
FIG. 7 is a schematic plan view of the printer according to a fifth embodiment of the present disclosure.

FIG. 7 is a schematic plan view of the printer 1 according to the fifth embodiment of the present disclosure.

The printer 1 according to the fifth embodiment includes the support 300 configured to be movable to a position at which the sealing 501 of the maintenance unit 500 is exposed outside the apparatus body 10 as illustrated in FIG. 7. Thus, the maintenance unit 500 is arranged at a position in the stage 301 to be exposed outside the apparatus body 10 when the stage 301 of the support 300 moves to a setting position to set the fabric 400 (print target) on the stage 301 of the support 300.

Thus, the sealing 501 of the maintenance unit 500 and the like can be easily cleaned by the user from outside of the apparatus body 10.

In the above-described configuration, at least a part of the sealing 501 of the maintenance unit 500 may be exposed outside an area of the apparatus body 10 in a plan view of a surface of the support 300 to support the fabric 400 (print target) from a direction indicated by arrow "A" in FIG. 2A.

Next, the printer 1 according to a sixth embodiment of the present disclosure is described with reference to FIGS. 8A and 8B.

Figure 8A:
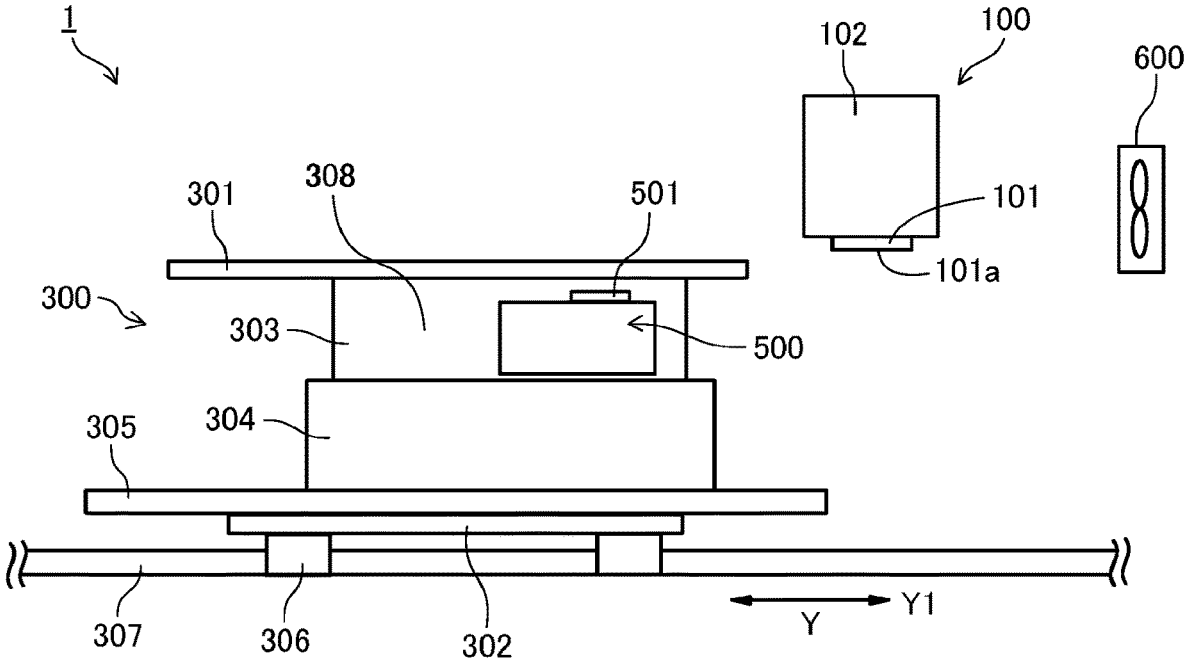
FIGS. 8A and 8B are schematic side views of the printer similar to FIGS. 3A and 3B to illustrate the printer according to a sixth embodiment of the present disclosure.
Figure 8B:
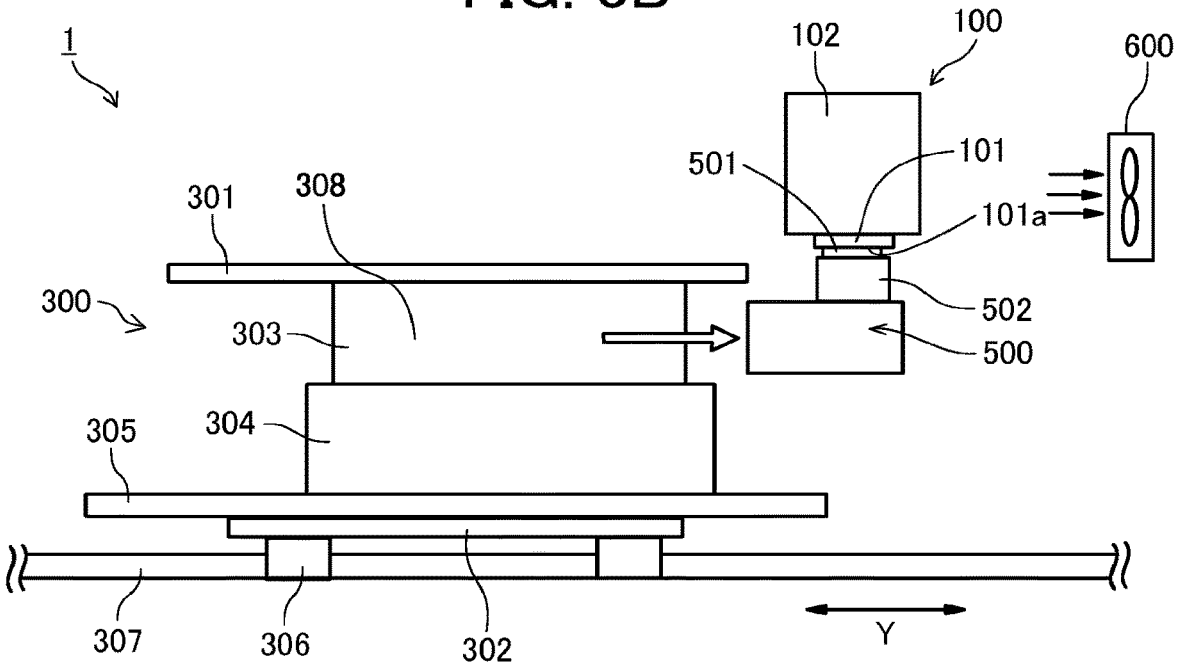

FIGS. 8A and 8B are schematic side views of the printer 1 similar to FIGS. 3A and 3B to illustrate the printer 1 according to the sixth embodiment.

The printer 1 according to the sixth embodiment includes the sealing 501 of the maintenance unit 500 configured to be movable to a position outside the support 300 in a moving direction (in the sub-scanning direction Y1) of the support 300 as indicated by arrow in FIG. 8B. Here, the maintenance unit 500 is movable to a sealing position at which the sealing 501 can seal the nozzle surface 101*a* of the head 101, and this sealing position is located at a rear side (right side in FIG. 8B) of the printer 1 in the apparatus body 10.

Thus, the sealing 501 of the maintenance unit 500 is movable between an accommodation position to accommodate the sealing 501 of the maintenance unit 500 in the support 300 and the sealing position at which the sealing 501 of the maintenance unit 500 moves outside the support 300 to seal the nozzle surface 101*a* of the head 101.

The printer 1 according to the sixth embodiment separates the maintenance unit 500 at the accommodation position as illustrated in FIG. 8A from the support 300 and moves the maintenance unit 500 in the sub-scanning direction Y1 (rightward direction in Y direction) to seal (cap) the nozzle surface 101*a* of the head 101 with the sealing 501, for example.

Then, as illustrated in FIG. 8B, the sealing 501 of the maintenance unit 500 moves to be disposed below the head 101. Then, the printer 1 elevates the sealing holder 502 of the maintenance unit 500 to seal (cap) the nozzle surface 101*a* of the head 101 with the sealing 501.

Thus, the printer 1 can continue to seal the nozzle surface 101*a* of the head 101 during setting the fabric 400 on the stage 301 of the support 300. Thus, the printer 1 can prevent drying of nozzles in the nozzle surface 101*a* of the head 101.

Further, the printer 1 in the sixth embodiment includes a fan 600 as an exhaust configured to exhaust air in the apparatus body 10 to the outside of the apparatus body 10. The fan 600 is arranged on the rear side (right side in FIGS. 8A and 8B) of the apparatus body 10 in the printer 1.

Further, the stage 301 of the support 300, the sealing 501 of the maintenance unit 500, and the fan 600 are arranged in this order when the sealing 501 of the maintenance unit 500 seals the nozzle surface 101*a* of the head 101 to perform a maintenance operation.

Thus, mist generated during the maintenance operation of the head 101 is vacuumed and discharged outside the apparatus body 10 by the fan 600. Thus, the printer 1 according to the sixth embodiment can reliably reduce soiling of the stage 301 of the support 300.

Thus, the sealing 501 moves closer to the fan 600 than the support 300 in the sub-scanning direction Y when the sealing 501 moves outside the space 308 to seal the nozzle surface 101*a* of the head 101.

The printer 1 according to a seventh embodiment of the present disclosure is described with reference to FIGS. 9A and 9B, and FIG. 10.

Figure 9A:
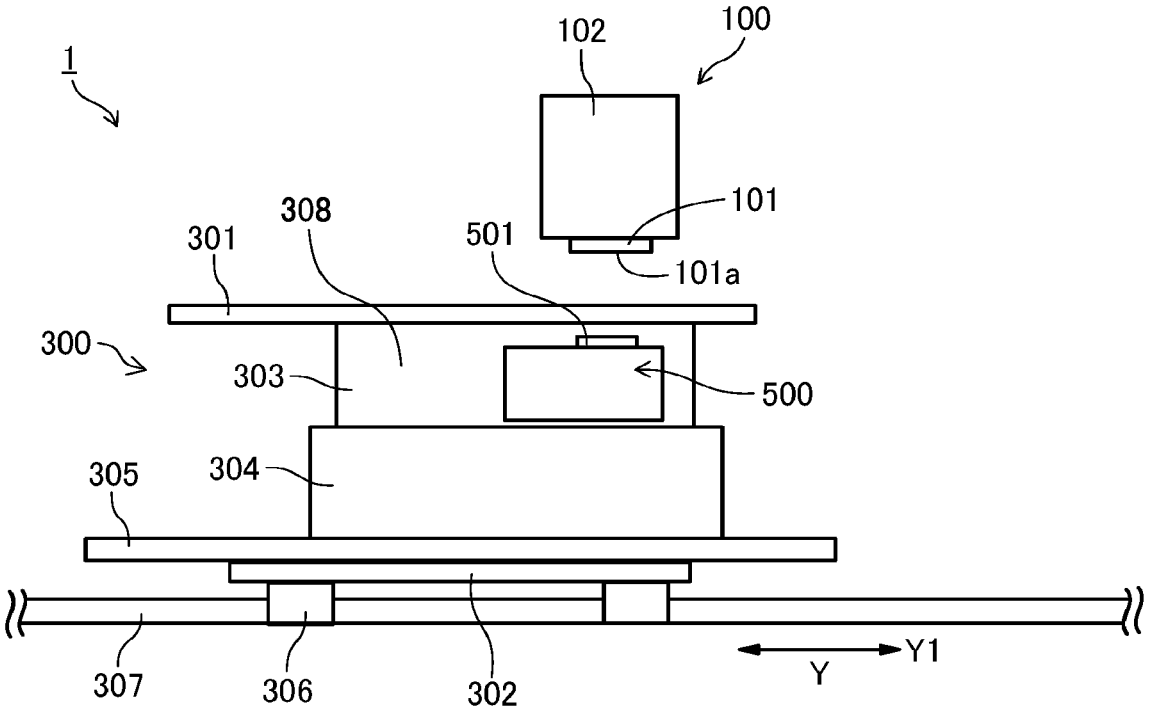
FIGS. 9A and 9B are schematic side views of the printer similar to FIGS. 3A and 3B to illustrate the printer according to a seventh embodiment of the present disclosure.
Figure 9B:
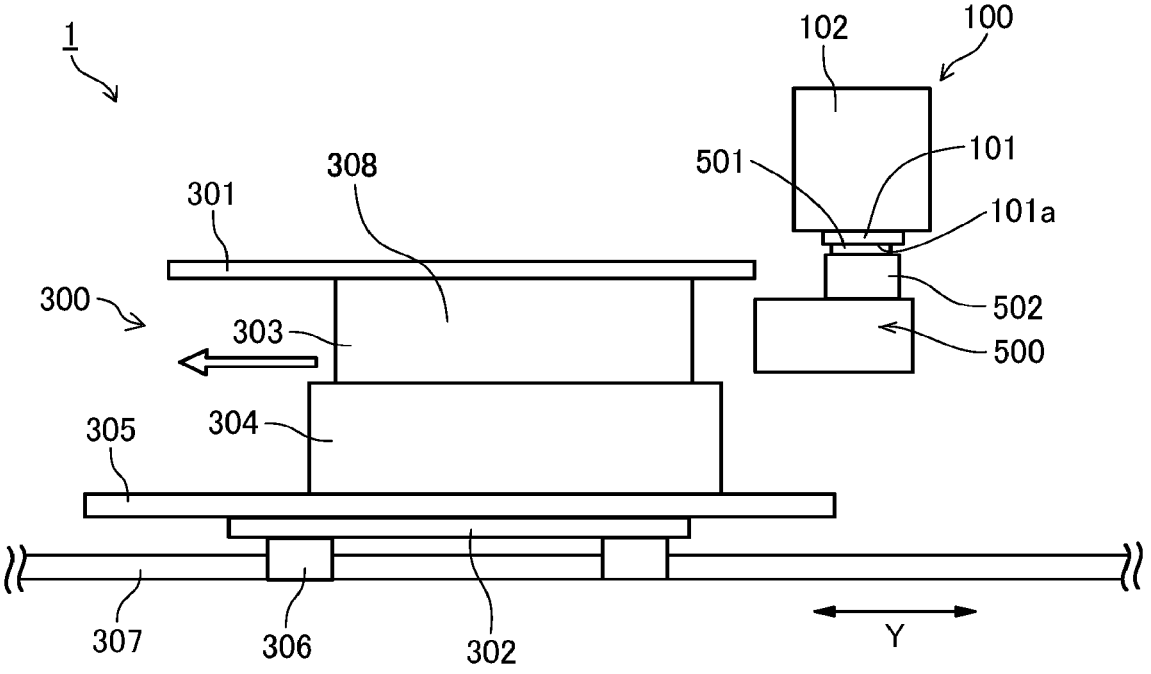

FIGS. 9A and 9B are schematic side views of the printer 1 similar to FIGS. 3A and 3B to illustrate the printer 1 according to the seventh embodiment.

Figure 10:
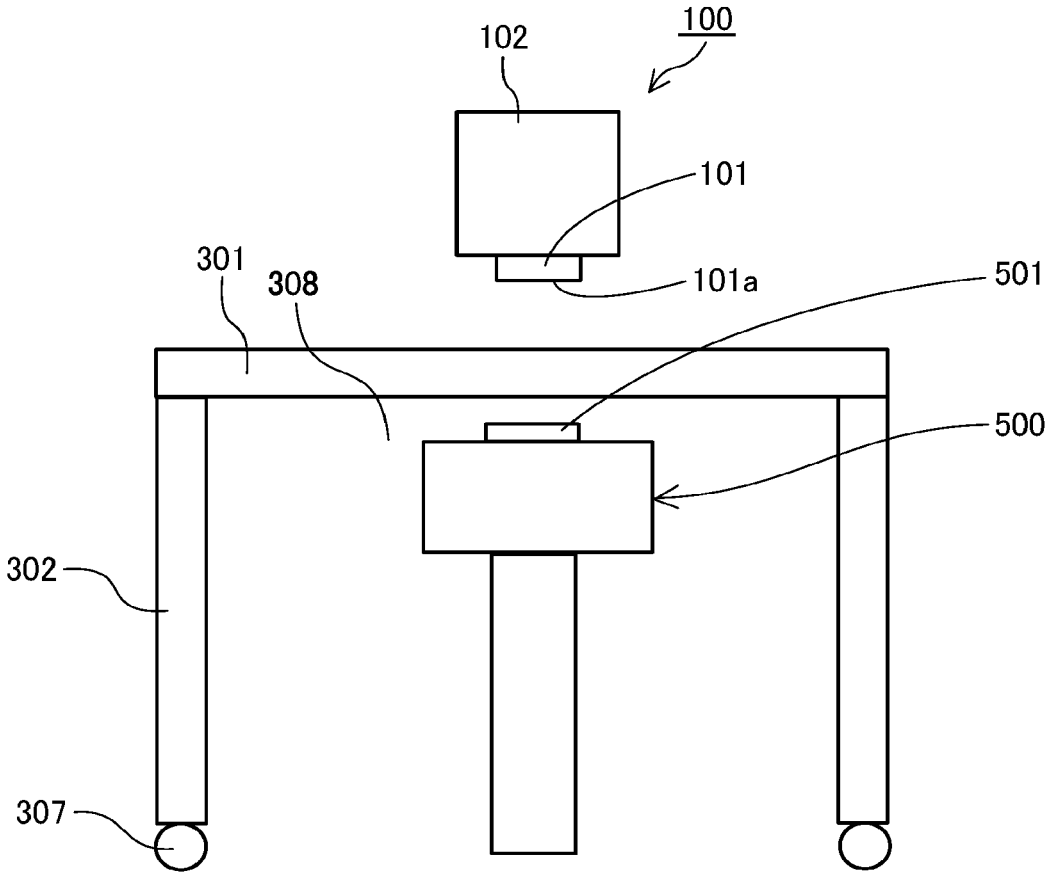
FIG. 10 is a schematic cross-sectional front view of the printer of FIGS. 9A and 9B.

FIG. 10 is a schematic cross-sectional front view of the printer of FIGS. 9A and 9B.

The printer 1 according to the seventh embodiment includes the sealing 501 of the maintenance unit 500 that is attached to the apparatus body 10 and is not inside the support 300.

The sealing 501 of the maintenance unit 500 is arranged in a liquid discharge direction of the head 101 in a scanning area of the head 101 (carriage 102). The sealing 501 of the maintenance unit 500 is elevatable and descendible in the vertical direction.

The support 300 includes a stage 301 and a slider 302 that configure a gate-like moving member. Thus, the stage 301 (support surface) of the support 300 that supports the fabric 400 (print target) is movable between the sealing 501 of the maintenance unit 500 and the head 101 while the sealing 501 of the maintenance unit 500 faces the head 101.

Thus, the support 300 includes a stage 301 on which the fabric 400 (print target) is placed, and the stage 301 is movable between the head 101 and the sealing 501 in a state in which the sealing 501 faces the head 101.

Thus, the sealing 501 of the maintenance unit 500 is arranged in an area in which the support 300 scans (moves) and the head 101 scans (moves). Thus, the printer according to the seventh embodiment can reduce a size of the apparatus body 10.

When the maintenance unit 500 maintains the head 101, the support 300 retracts to a front of the apparatus body 10 (in a leftward direction indicated by arrow in FIG. 9B) or to a rear of the apparatus body 10 (in a right side of the maintenance unit 500 in FIG. 9B).

Thus, the support 300 moves to a position that does not overlap and cover an upper part of the maintenance unit 500 such as sealing 501. Thus, the printer 1 according the seventh embodiment does not have to secure a space in the apparatus body 10 for the maintenance unit 500. Thus, the printer according to the seventh embodiment can reduce a size of the apparatus body 10.

Next, the printer 1 according to an eighth embodiment of the present disclosure is described with reference to FIG. 11.

Figure 11:
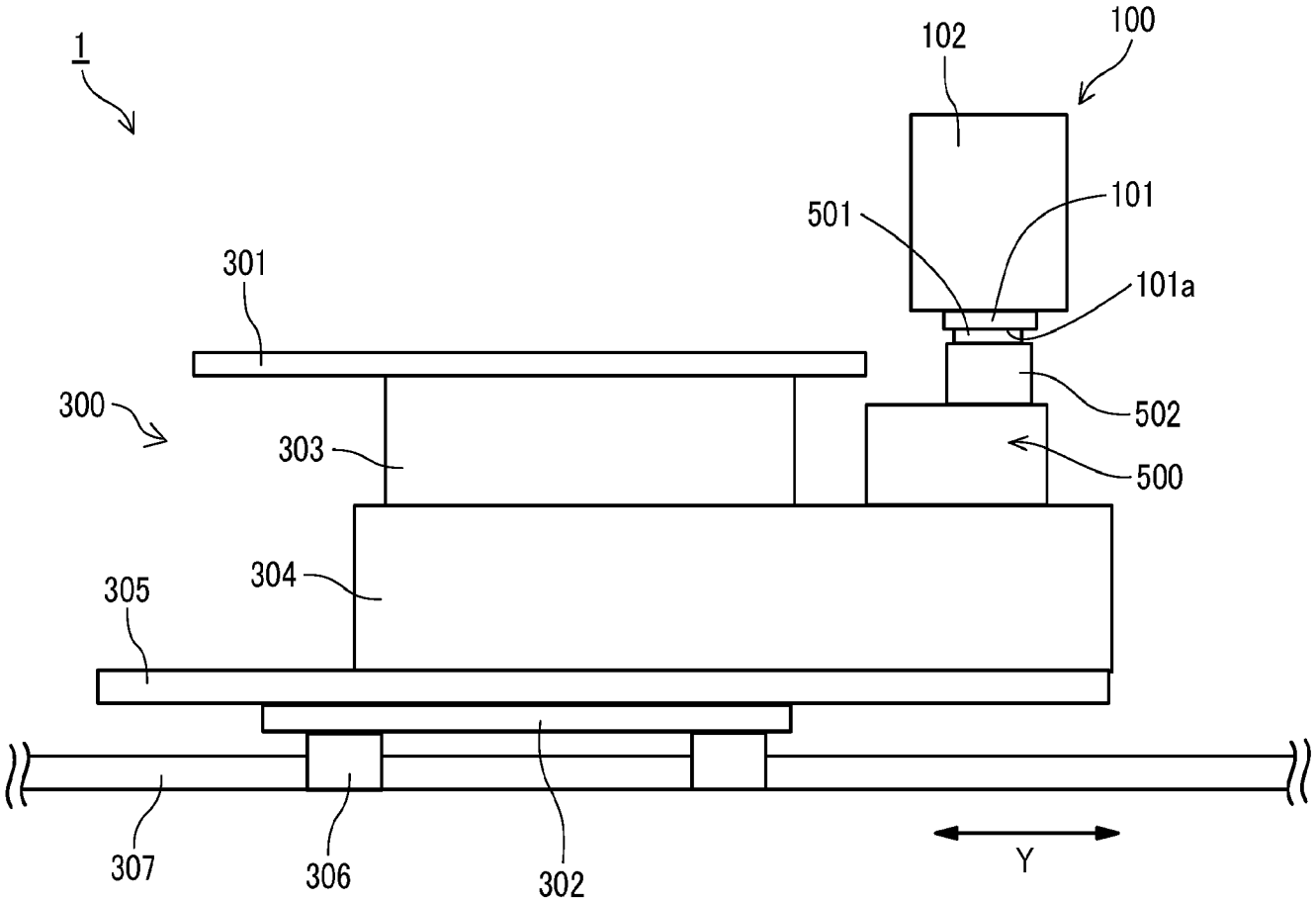
FIG. 11 is a schematic side views of the printer similar to FIGS. 3A and 3B to illustrate the printer according to an eighth embodiment of the present disclosure.

FIG. 11 is a schematic side views of the printer 1 similar to FIGS. 3A and 3B to illustrate the printer 1 according to the eighth embodiment.

The printer 1 according to the eighth embodiment includes the sealing 501 of the maintenance unit 500 disposed outside of the support 300 and not inside of the support 300. For example, the sealing 501 of the maintenance unit 500 is arranged on the lower stage cover 304. As illustrated in FIG. 11, the upper stage cover 303 and the maintenance unit 500 are parallelly disposed on the lower stage cover 304 in the sub-scanning direction Y.

Thus, the support 300 (conveyor) includes the stage 301 on which the fabric 400 (print target) is placed, a stage cover (lower stage cover 304) configured to movably support the stage 301 in the sub-scanning direction Y. The stage 301 and the sealing 501 are parallelly disposed on the stage cover (lower stage cover 304) in the sub-scanning direction Y.

Further, the sealing 501 is disposed outside the stage 301 on the stage cover (lower stage cover 304) in the sub-scanning direction Y.

The sealing 501 of the maintenance unit 500 may be arranged within a width of the stage 301 in main-scanning direction X (see FIG. 2A) perpendicular to the sub-scanning direction Y (see FIG. 11) in a plan view of a surface of the support 300 to support the fabric 400 (print target) from a direction indicated by arrow "A" in FIG. 2A. The support 300 moves (scans) in the sub-scanning direction Y.

Thus, the printer 1 in the eighth embodiment can also reduce (shorten) a width of the apparatus body 10 of the printer 1 in the main-scanning direction X (X direction).

The printer 1 according to a ninth embodiment of the present disclosure is described with reference to FIGS. 12 and 13.

Figure 12:
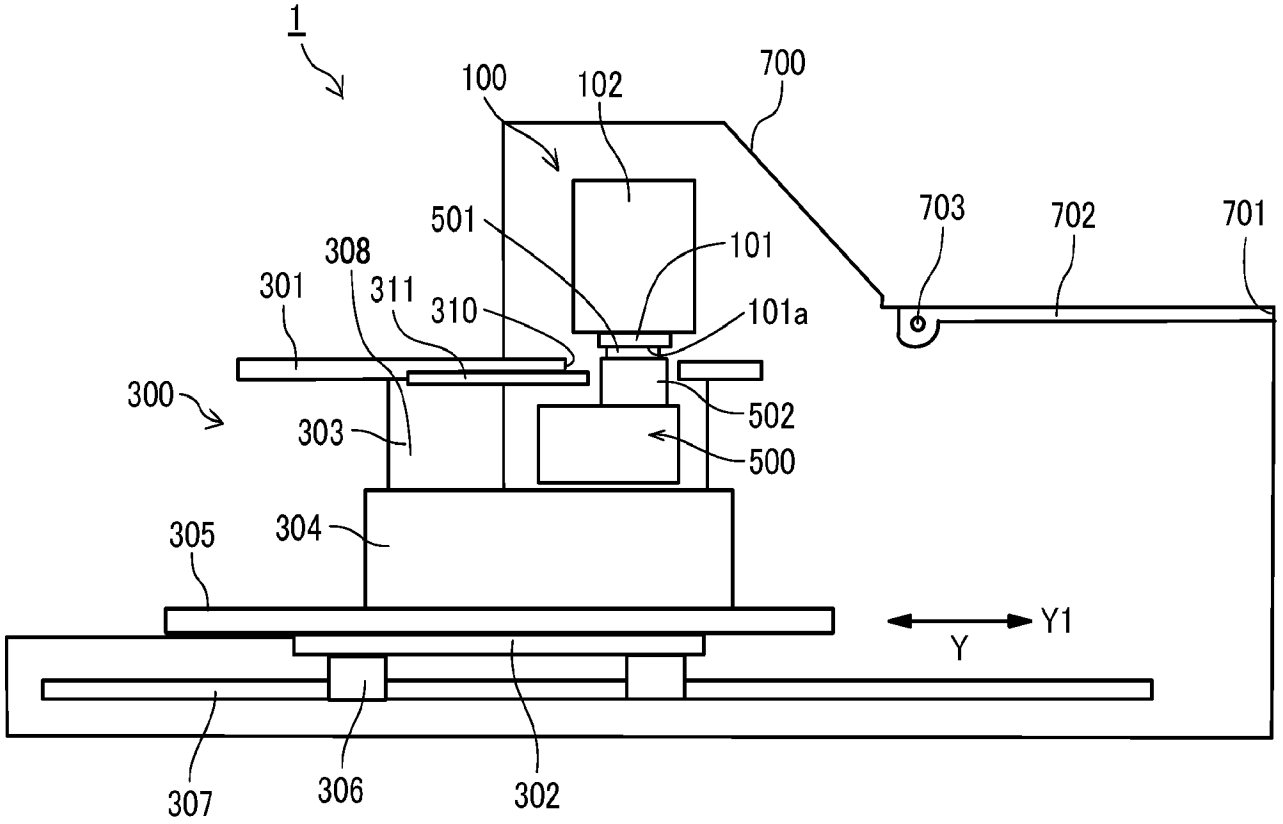
FIG. 12 is a schematic cross-sectional side view of the printer according to a ninth embodiment illustrating the printer in which a cover is closed.

FIG. 12 is a schematic cross-sectional side view of the printer 1 according to the ninth embodiment illustrating the printer 1 in which the cover 702 is closed.

Figure 13:
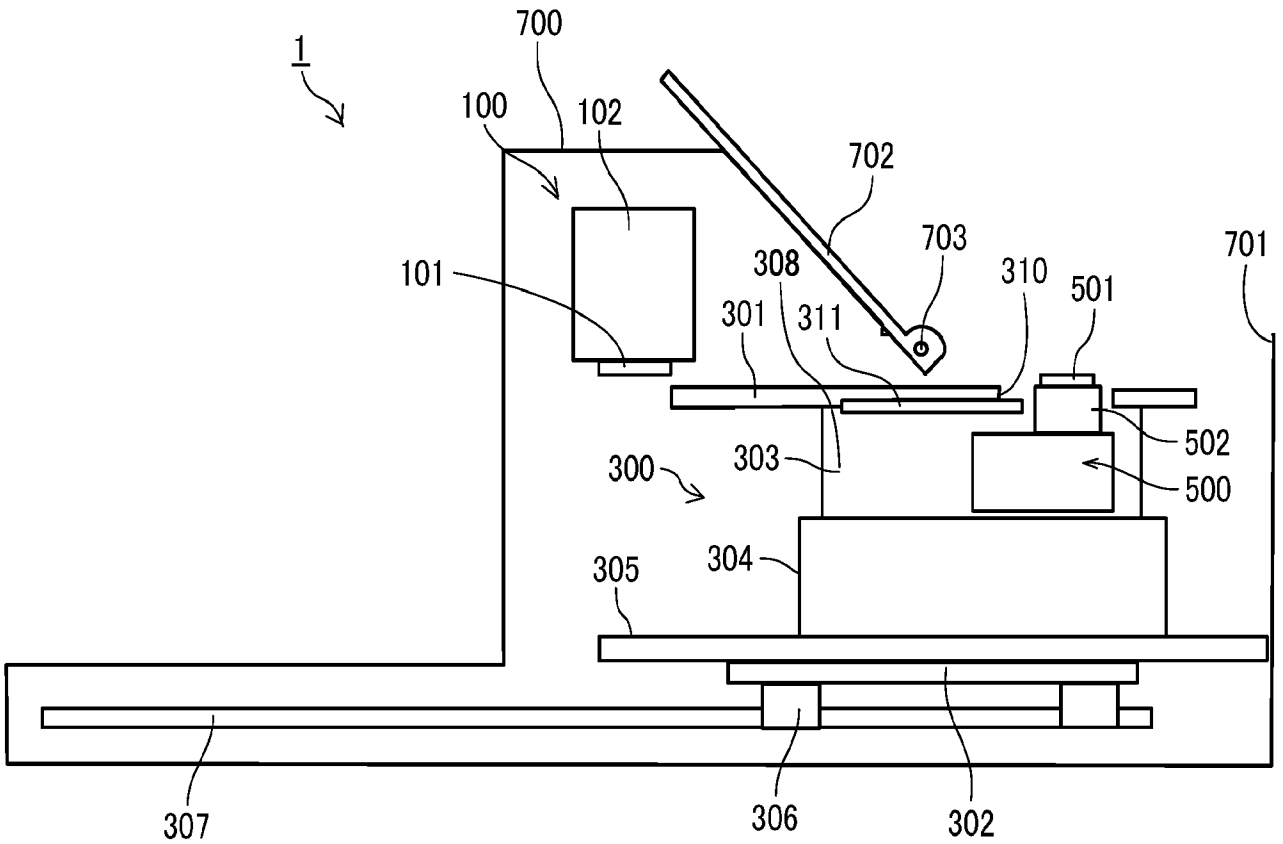
FIG. 13 is a schematic cross-sectional side view of the printer according to the ninth embodiment illustrating the printer in which the cover is closed.

FIG. 13 is a schematic cross-sectional side view of the printer 1 according to the ninth embodiment illustrating the printer 1 in which the cover 702 is opened.

The printer 1 includes a housing 700 that covers at least the head 101 and the sealing 501. The housing 700 in the ninth embodiment is an exterior of the printer 1 and covers the printing device 100 including the head 101 and the maintenance unit 500 including the sealing 501. The housing 700 is another example of the apparatus body 10 as illustrated in FIGS. 1 to 11.

The housing 700 includes an opening 701 and a cover 702 (openably closable member) configured to openably cover and close the opening 701. The opening 701 opens at least a part of the housing 700, and the cover 702 openably closes the opening 701. The cover 702 is rotatably held by the housing 700 by the shaft 703.

The housing 700 is different from the apparatus body 10 in including the opening 701 and the cover 702.

The opening 701 openably closed by the cover 702 is disposed at a position at which the sealing 501 faces the opening 701 by moving the maintenance unit 500 in the rightward direction Y1 of the sub-scanning direction Y (see FIG. 12). The printer 1 according to the ninth embodiment can move the sealing 501 to an interior of an area of the opening 701, that is, directly below the opening 701 when viewed from an upper side of the printer 1 in the vertical direction in a state in which the printer 1 is installed.

The printer 1 with such a configuration moves the maintenance unit 500 from the sealing position as illustrated in FIG. 12 to the cleaning position as illustrated in FIG. 13. Thus, the sealing 501 faces the opening 701.

Thus, when the cover 702 is opened to open the opening 701, the user can access the sealing 501 from outside of the apparatus body 10. Thus, the user can easily clean the sealing 501.

Next, the printer 1 according to a tenth embodiment of the present disclosure is described with reference to FIGS. 14 to 16.

Figure 14:
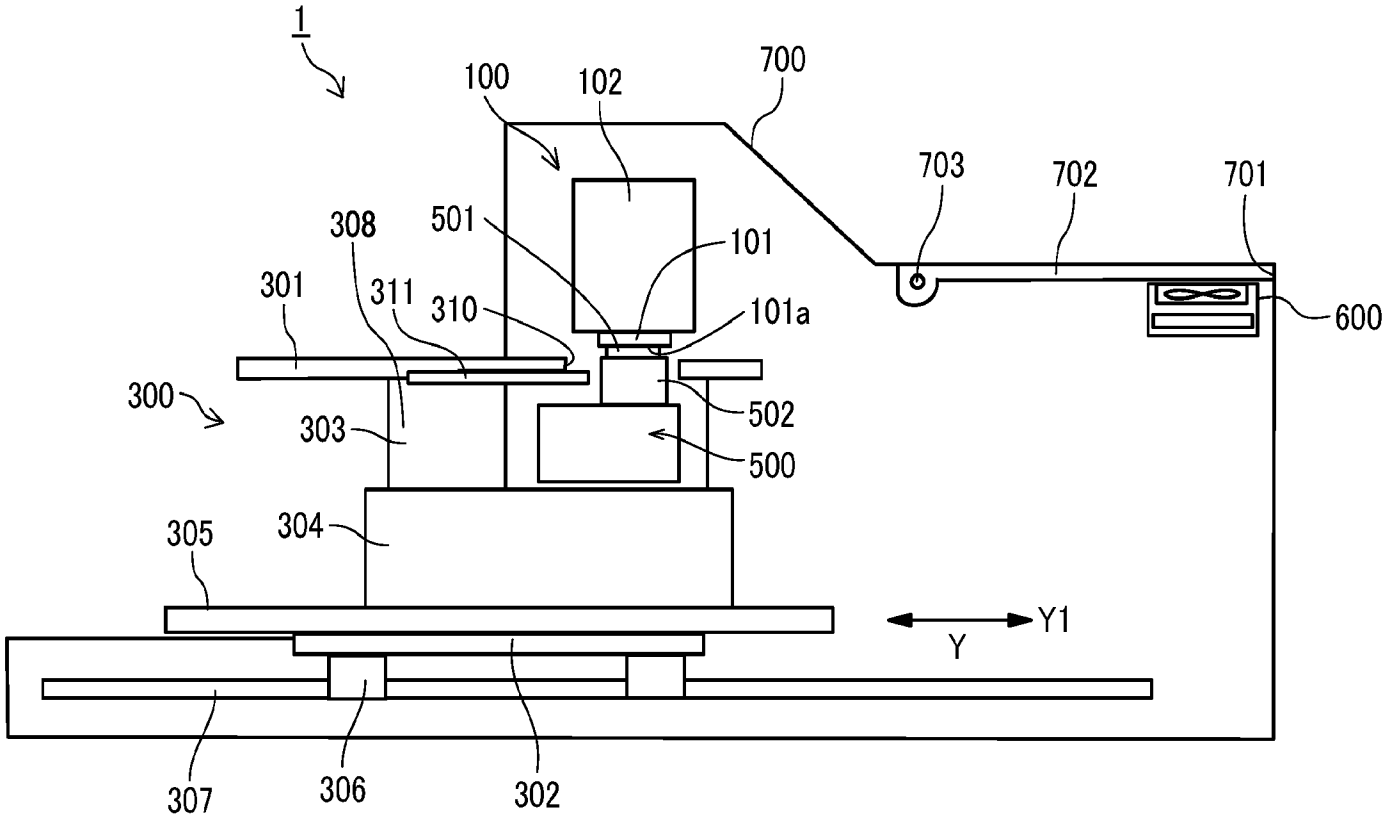
FIG. 14 is a schematic cross-sectional side view of the printer according to a tenth embodiment illustrating the printer in which the cover is closed.

FIG. 14 is a schematic cross-sectional side view of the printer 1 according to the tenth embodiment illustrating the printer 1 in which the cover 702 is closed.

Figure 15:
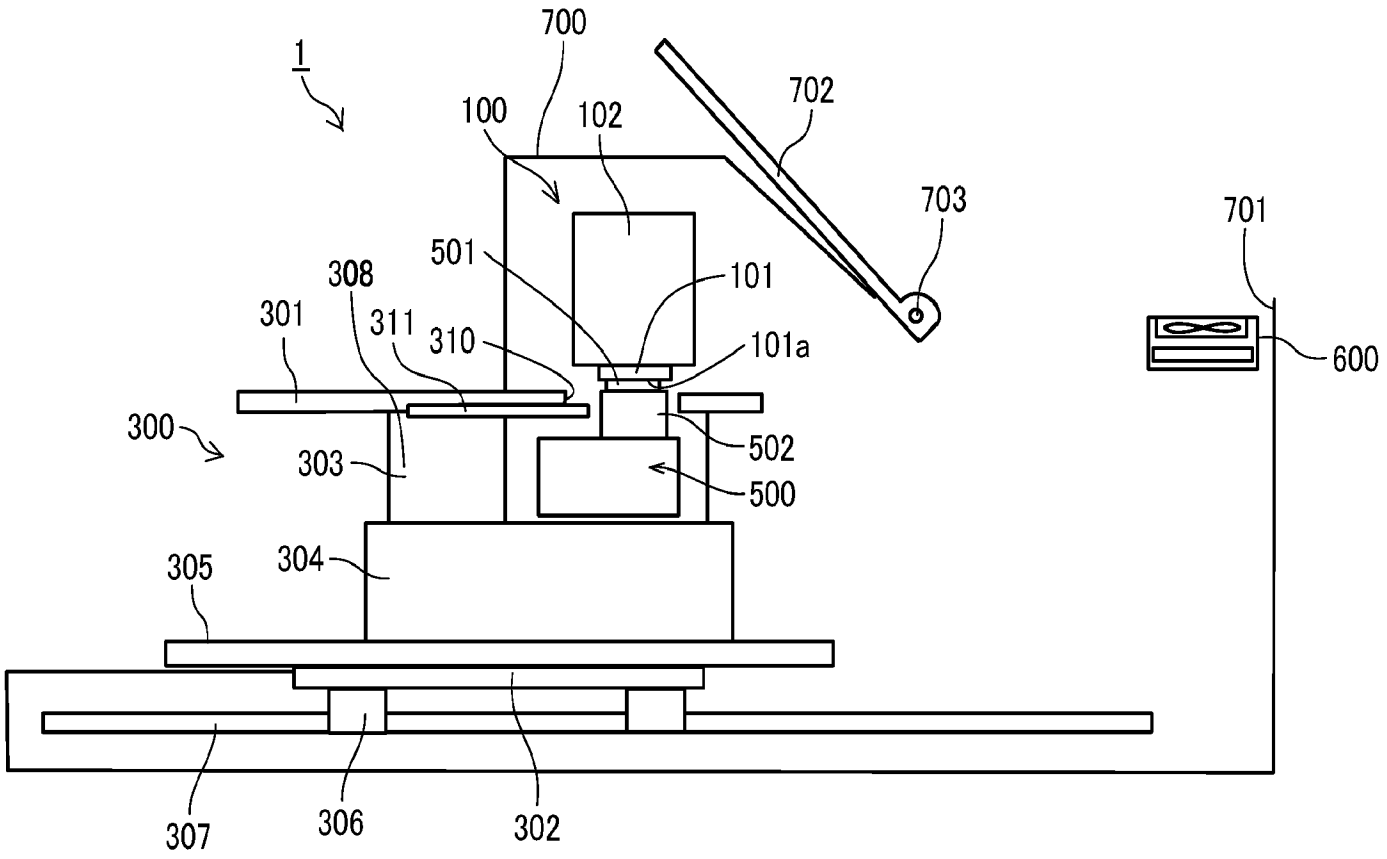
FIG. 15 is a schematic cross-sectional side view of the printer according to the tenth embodiment illustrating the printer in which the cover is opened.
Figure 16:
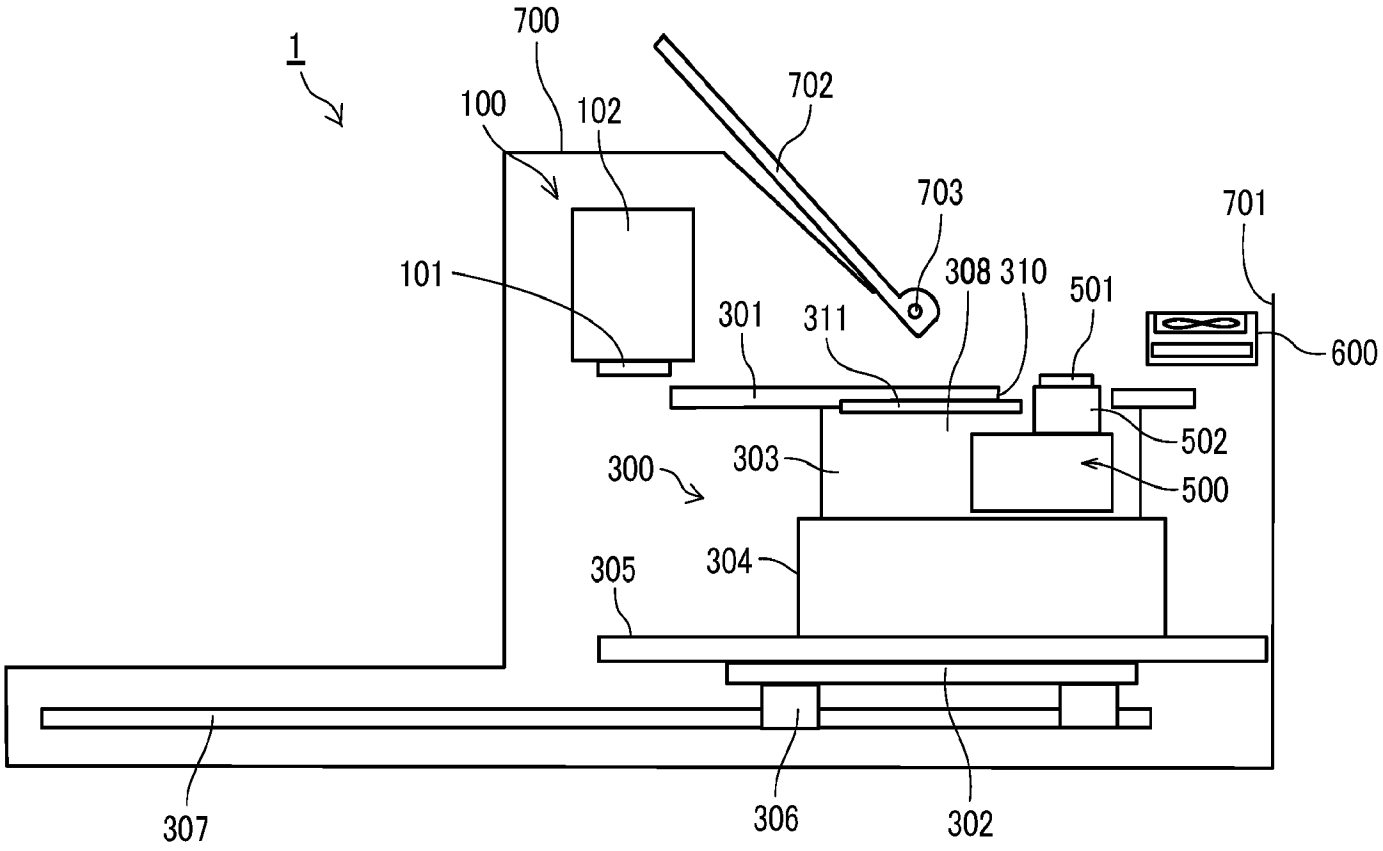
FIG. 16 is a schematic cross-sectional side view of the printer according to the tenth embodiment illustrating the printer in which the cover is opened.

FIGS. 15 and 16 are schematic cross-sectional side views of the printer 1 according to the tenth embodiment illustrating the printer 1 in which the cover 702 is opened.

The printer 1 includes a housing 700 that covers at least the head 101 and the sealing 501. The housing 700 in the tenth embodiment is an exterior of the printer 1 and covers the printing device 100 including the head 101 and the maintenance unit 500 including the sealing 501.

The housing 700 includes an opening 701 and a cover 702 (openably closable member) configured to openably close the opening 701. The opening 701 opens at least a part of the housing 700 and the cover 702 openably closes the opening 701. The cover 702 is rotatably held by the housing 700 by the shaft 703.

The opening 701 openably closed by the cover 702 is disposed at a position at which the sealing 501 faces the opening 701 by moving the maintenance unit 500 in the rightward direction Y1 of the sub-scanning direction Y (see FIG. 12). Further, the printer 1 includes the fan 600 (exhaust) in a vicinity of the opening 701. The fan 600 is exposed to the opening 701 when the cover 702 is opened.

The printer 1 according to the ninth embodiment can move the sealing 501 to an interior of an area of the opening 701, that is, directly below the opening 701 when viewed from an upper side of the printer 1 in the vertical direction in a state in which the printer 1 is installed.

The printer 1 with such a configuration opens the cover 702 to open the opening 701 as illustrated in FIG. 15, for example, to clean the fan 600. Thus, the fan 600 (exhaust) becomes accessible from outside of the apparatus body 10. Thus, the user can easily clean the fan 600 (exhaust).

The printer 1 with such a configuration moves the maintenance unit 500 from the sealing position as illustrated in FIG. 14 to the cleaning position as illustrated in FIG. 16. Thus, the sealing 501 faces the opening 701.

Thus, when the cover 702 is opened to open the opening 701, the user can access the sealing 501 and the fan 600 from outside of the apparatus body 10. Thus, the user can easily clean the sealing 501 and also easily clean the fan 600.

Each of the above-described embodiments describes an example of the printer 1 that applies a liquid onto the fabric 400 as the print target. However, the printer 1 according to the present embodiments may be similarly applied to a liquid discharge apparatus that applies a liquid onto a sheet other than the fabric 400 as the print target, for example.

In the above-described embodiments, the "liquid discharge apparatus" includes the head or the liquid discharge device and drives the head to discharge liquid.

The liquid discharge apparatus may be, for example, an apparatus capable of discharging liquid to a material onto which liquid can adhere and an apparatus to discharge liquid toward gas or into liquid.

The "liquid discharge apparatus" may include devices to feed, convey, and eject the material onto which liquid can adhere.

The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabrication apparatus to discharge a fabrication liquid to a powder layer in which powder material is formed in layers to form a three-dimensional fabrication object.

The "liquid discharge apparatus" is not limited to an apparatus to discharge liquid to visualize meaningful images, such as letters or figures.

For example, the liquid discharge apparatus may be an apparatus to form arbitrary images, such as arbitrary patterns, or fabricate three-dimensional images.

The above-described term "material onto which liquid can adhere" represents a material on which liquid is at least temporarily adhered, a material on which liquid is adhered and fixed, or a material into which liquid is adhered to permeate.

Examples of the "material onto which liquid can adhere" include recording media, such as paper sheet, recording paper, recording sheet of paper, film, and cloth, electronic component, such as electronic substrate and piezoelectric element, and media, such as powder layer, organ model, and testing cell.

The "material onto which liquid can adhere" includes any material on which liquid is adhered, unless particularly limited.

Examples of the "material onto which liquid can adhere" include any materials on which liquid can adhere even temporarily, such as paper, thread, fiber, fabric, leather, metal, plastic, glass, wood, and ceramic.

Further, the term "liquid" includes any liquid having a viscosity or a surface tension that is dischargeable from the head.

However, preferably, the viscosity of the liquid is not greater than 30 mPa·s under ordinary temperature and ordinary pressure or by heating or cooling.

Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant.

Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

The "liquid discharge apparatus" may be an apparatus to relatively move the head and a material on which liquid can adhere.

However, the liquid discharge apparatus is not limited to such an apparatus. For example, the liquid discharge apparatus may be a serial head apparatus that moves the head or a line head apparatus that does not move the head.

Examples of the "liquid discharge apparatus" further include a treatment liquid coating apparatus to discharge a treatment liquid to a sheet surface to coat the treatment liquid on the sheet surface to reform the sheet surface and an injection granulation apparatus in which a composition liquid including raw materials dispersed in a solution is injected through nozzles to granulate fine particles of the raw materials.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge apparatus comprising:
a head configured to discharge a liquid onto a print target;
a carriage configured to hold the head and reciprocally movable in a main-scanning direction;
a sealing configured to seal a nozzle surface of the head; and
a support configured to hold the print target and movable in a sub-scanning direction perpendicular to the main-scanning direction, the support including a space configured to accommodate the sealing in the support.

2. The liquid discharge apparatus according to claim 1,
wherein the support includes:
a stage on which the print target is placed;
an opening in the stage; and
a shutter configured to openably close the opening, and
the sealing is configured to pass through the opening to move to a sealing position to seal the nozzle surface of the head.

3. The liquid discharge apparatus according to claim 2,
wherein the sealing is inside an area of the opening in a plan view of the stage.

4. The liquid discharge apparatus according to claim 1,
wherein the support includes:
a stage on which the print target is placed;
an opening in the stage; and
a shutter configured to openably close the opening, and
the head is configured to pass through the opening to move to a sealing position at which the sealing seals the nozzle surface of the head.

5. The liquid discharge apparatus according to claim 4,
wherein the sealing is inside an area of the opening in a plan view of the stage.

6. The liquid discharge apparatus according to claim 1,
wherein the sealing is movable outside the space of the support in the sub-scanning direction.

7. The liquid discharge apparatus according to claim 6, further comprising:
a fan configured to exhaust an air in the liquid discharge apparatus,
wherein the sealing is closer to the fan than the support in the sub-scanning direction when the sealing seals the nozzle surface of the head.

8. The liquid discharge apparatus according to claim 1,
wherein the support is movable to a position at which the sealing is exposed outside the liquid discharge apparatus.

9. The liquid discharge apparatus according to claim 1, further comprising:
a housing including an opening and a cover configured to openably cover the opening, the housing configured to accommodate the head and the sealing and expose the sealing to an outside of the housing from the opening with opening of the cover.

10. The liquid discharge apparatus according to claim 9, further comprising:
a fan configured to exhaust an air in the housing,
wherein the housing is configured to expose the sealing and the fan to the outside of the housing from the opening with opening of the cover.

11. The liquid discharge apparatus according to claim 9,
wherein the sealing is movable to a position facing the cover of the housing in the sub-scanning direction.

12. The liquid discharge apparatus according to claim 1,
wherein the support includes a stage on which the print target is placed, and
the stage is movable in the sub-scanning direction between the head and the sealing in a state in which the sealing faces the head.

13. The liquid discharge apparatus according to claim 1,
wherein the sealing is disposed inside a region of the support in the main-scanning direction.

14. The liquid discharge apparatus according to claim 1,
wherein the sealing is disposed inside a region of the support in the sub-scanning direction.

15. The liquid discharge apparatus according to claim 1,
wherein the sealing includes a cap configured to cap the nozzle surface of the head.

16. The liquid discharge apparatus according to claim 1,
wherein the support includes a conveyor configured to convey the print target in the sub-scanning direction, and
the sealing is inside the conveyor.

17. A liquid discharge apparatus comprising:
a head configured to discharge a liquid onto a print target;
a sealing configured to seal a nozzle surface of the head; and
a conveyor configured to convey the print target in a sub-scanning direction,
wherein the conveyor includes:

a stage on which the print target is placed; and a stage cover movable in the sub-scanning direction and configured to support the stage, wherein the stage and the sealing are parallelly disposed on the stage cover in the sub-scanning direction, and wherein the stage cover forms a space configured to accommodate the sealing.

18. The liquid discharge apparatus according to claim 17, wherein the sealing is outside the stage on the stage cover in the sub-scanning direction.

* * * * *